United States Patent [19]

Latham

[11] Patent Number: 4,887,361

[45] Date of Patent: Dec. 19, 1989

[54] STREAMLINED FREEBOARD MEASURING DEVICE

[76] Inventor: Philip A. Latham, 226 Walter Rd., River Ridge, La. 70123

[21] Appl. No.: 243,686

[22] Filed: Sep. 13, 1988

[51] Int. Cl.[4] ..... G01B 3/02

[52] U.S. Cl. ..... 33/720; 33/717; 73/300

[58] Field of Search ..... 33/126, 126.4 R, 126.4 P, 33/126.7 R, 126.5, 717, 718, 719, 720, 721, 722, 727, 729, 730; 73/300, 170 A, 322.5, 321, 319

[56] References Cited

U.S. PATENT DOCUMENTS

| | | | |
|---|---|---|---|
| 1,306,453 | 6/1919 | Williams | 33/126.5 |
| 1,456,334 | 5/1923 | Parrott | 33/126.5 |
| 1,478,288 | 12/1923 | MacGregor | 33/126.4 R |
| 2,210,775 | 8/1940 | Perry | 33/126.5 |
| 3,113,285 | 12/1963 | Edwards | 73/170 A |
| 3,396,470 | 8/1968 | Wood | 33/126.5 |
| 3,848,464 | 11/1974 | Scheipner et al. | 73/170 A |
| 4,010,706 | 3/1977 | Pretet | 73/170 A |
| 4,712,305 | 12/1987 | Latham | 33/126.5 |

*Primary Examiner*—William A. Cuchlinski, Jr.
*Assistant Examiner*—Jeffrey J. Hohenshell
*Attorney, Agent, or Firm*—Keaty & Keaty

[57] ABSTRACT

The invention relates to a freeboard measuring device which comprises an elongated housing having a rectangular cross-section form, a central part of the device body. A pair of fins fixedly connected to the housing on each of its sides extend substantially the length of the housing and have at least slightly greater lateral dimensions than the lateral dimension of the housing. The fins are triangular in cross section, with the tops of the triangles facing outwardly and providing the device with streamlined characteristics. The base of the triangles does not exceed in length the depth of the housing. The central portion has a main chamber for housing a gauging stick. The main chamber is divided into a lower and upper secondary chamber with the lower chamber having water ingress and separated from the upper chamber by a separation wall with openings to allow water to enter the upper chamber. The lower chamber has a packing of fibrous material to prevent water turbulence. The gauging stick has a strip of water-sensitive material fixedly attached thereto, the water sensitive material retaining, at least temporarily, a water mark. The bottom of the stick is concave or jagged so as not to impede the water flow. The open top of the main chamber is closed by a plug affixed to the top of the dipstick to prevent rain from entering the upper chamber and obstructing measurements. A stablizing transverse bar provided by a second embodiment of the invention prevents rotation of the device in strong currents.

30 Claims, 4 Drawing Sheets

STREAMLINED FREEBOARD MEASURING DEVICE

BACKGROUND OF THE INVENTION

The present invention relates to gauging devices, and more particularly to devices for measuring freeboard of ships, barges or other vessels carrying various amounts of cargo.

In the shipping industry, there exists a need to swiftly and accurately measure freeboard of vessels that are often placed in swift current and/or choppy water conditions. There are known devices which are designed to measure freeboard of barges to determine varying amount in cargo loads, one of such devices being a device disclosed in U.S. Pat. No. 4,712,305 issued on Dec. 15, 1987 for "Freeboard Measuring Device".

While the device of '305 patent can be successfully used in relatively strong currents, still a device was found to provide not highly accurate readings in severe choppy waters and/or swift currents.

To overcome the shortcomings of the device offered by '305 patent, the object of the present invention is to provide a device and method for measuring the change in freeboard of a barge or other vessel, which will be indicative of a varying amount of cargo under still, as well as adverse water conditions, wherein currents or choppy waters usually prevent obtaining accurate freeboard readings.

It is a further object of the present invention to provide a streamlined freeboard measuring device suitable for use under conditions, when barges are closely positioned together with very little space for lowering of a gauging device.

It is a further object of the present invention to provide a freeboard measuring device which allows swift and accurate freeboard measurement from different parts of the barge or other vessel in rapid succession.

These and other objects of the present invention will be more apparent from the following description of the invention.

SUMMARY OF THE INVENTION

The device of the present invention overcomes deficiencies of the prior art and solves its problems in a simple and straightforward manner. An elongated housing having a rectangular cross-section forms a central part of the device body. A pair of fins fixedly connected to the housing on each of its sides extend substantially the length of the housing and have at least slightly greater lateral dimensions than the lateral dimension of the housing. The fins are triangular in cross section, with the tops of the triangles facing outwardly and providing the device with streamlined characteristics. The base of the triangles does not exceed in length the depth of the housing. The central portion has a main chamber for housing a gauging stick. The main chamber is divided into a lower and upper secondary chamber with the lower chamber having water ingress means and separated from the upper chamber by a separation wall with openings to allow water to enter the upper chamber. The lower chamber has a packing of fibrous material to prevent water turbulence. The gauging stick has a strip of water sensitive material fixedly attached thereto, the water sensitive material retaining, at least temporarily, a water mark. The bottom of the stick is concave or jagged so as not to impede the water flow.

The open top of the main chamber is closed by a plug affixed to the top of the dipstick to prevent rain from entering the upper chamber and obstructing measurements.

A stabilizing transverse bar provided by a second embodiment of the invention prevents rotation of the device in strong currents.

DETAILED DESCRIPTION OF THE PREFERRED EMBODIMENT

Figure 1:
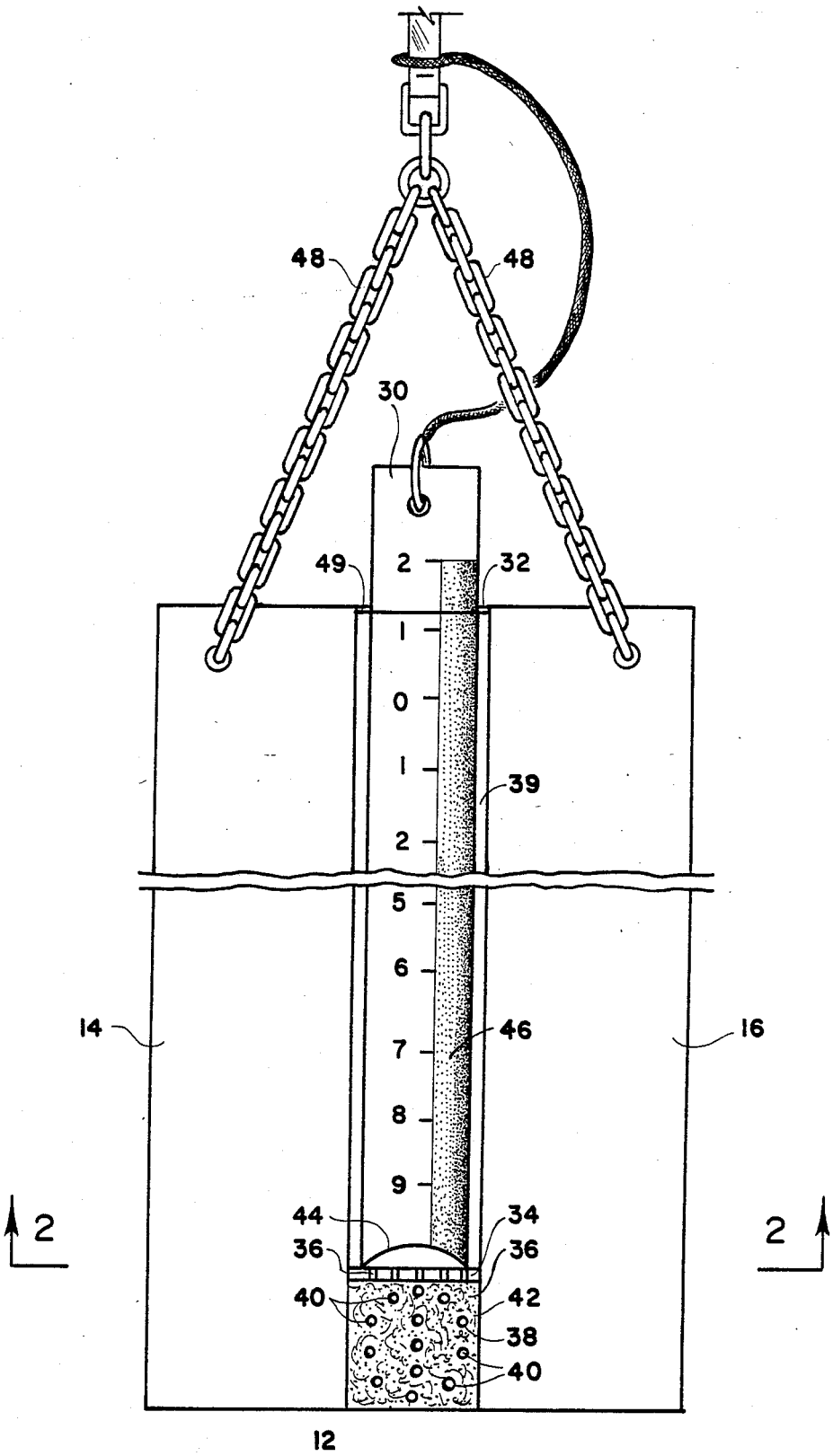
FIG. 1 is a front view of the freeboard measuring device in accordance with the present invention.
Figure 2:
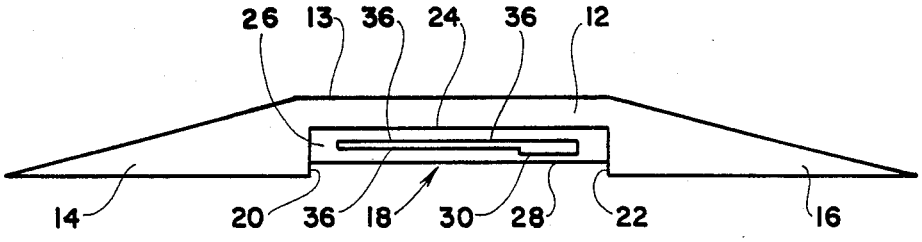
FIG. 2 is a cross-sectional view taken along lines 2—2 of FIG. 1.

Referring now to the drawings in more details, wherein the like numerals indicate identical or corresponding parts throughout the several views, and more particularly to FIGS. 1 and 2, thereof, the first embodiment of the measuring device of the present invention is shown. The freeboard measuring device is generally designated by numeral 10 and comprises a central portion 12, the first fin 14 and a second fin 16 integrally connected to the central portion 12. The central portion 12 has a substantially rectangular cross-section, while the fins 14 and 16 have a substantially triangular cross-section, with the bases of the triangles integrally connected to the central portion 12. As can be seen in FIG. 2, the fins 14 and 16 have a cross-section of right triangular shape, although other suitable triangular forms can be utilized, but one that produces the least overall thickness is most desirable. Outermost edges of the fins 14 and 16 are sharpened to offer less resistance to water flow.

The central portion 12 has a recessed part 18 cut throughout its length and defined by a base wall 20 of the fin 14 and a base wall 22 of the fin 16. The innermost wall 24 of the recessed part 18 is in substantially perpendicular relationship to the walls 20 and 22.

A centrally located chamber 26 of the central portion 12 is defined by the walls 24, portions of walls 20 and 22 and a recessed wall 28, which extends perpendicularly to the walls 20 and 22 and substantially parallel to the wall 24. The wall 28 is preferably made of a transparent material, such as high impact plastic, or other similar material having similar physical properties, the purpose of which will be explained in more detail hereinafter.

The chamber 26 is designed to accommodate a gauging stick 30 which is lowered through an open top 32 of the chamber 26 to a distance down the chamber and rests, with its lower end on a separation wall 34, which traverses the chamber 26 in its lower part.

The wall 34 is provided with a plurality of openings 36 in order to allow fluid communication between the lower chamber portion 38 and upper chamber portion 39.

The transparent wall 28, in its lowermost part, on the level of portion 38 of the chamber 26 is provided with a plurality of ports 40 which allow fluid communication between interior of the chamber 38 and exterior of the device 10.

In order to prevent turbulence of water within the chamber 38, a packing of fibrous material 42 is placed in the chamber, substantially filling the confines thereof, still not impeding the flow of water from lower chamber 38, through the openings 36, into the upper chamber 39.

Figure 5:
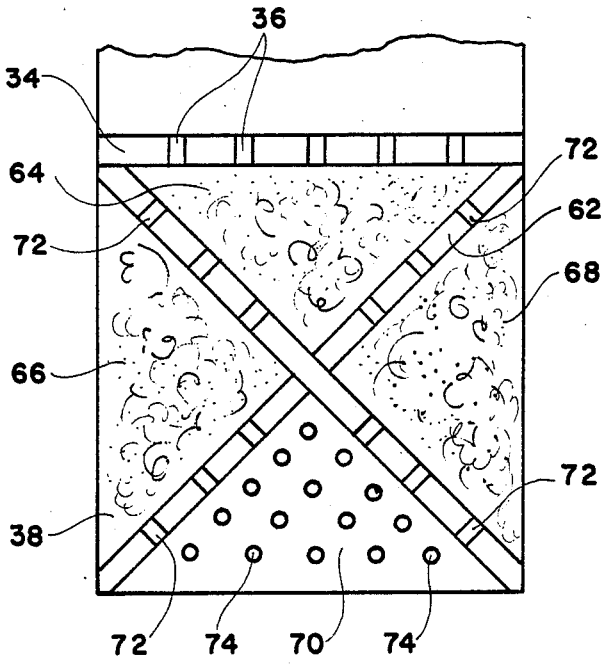
FIG. 5 is a front view of the lower section of the freeboard measuring device in accordance with the embodiment of FIG. 4.
Figure 4:
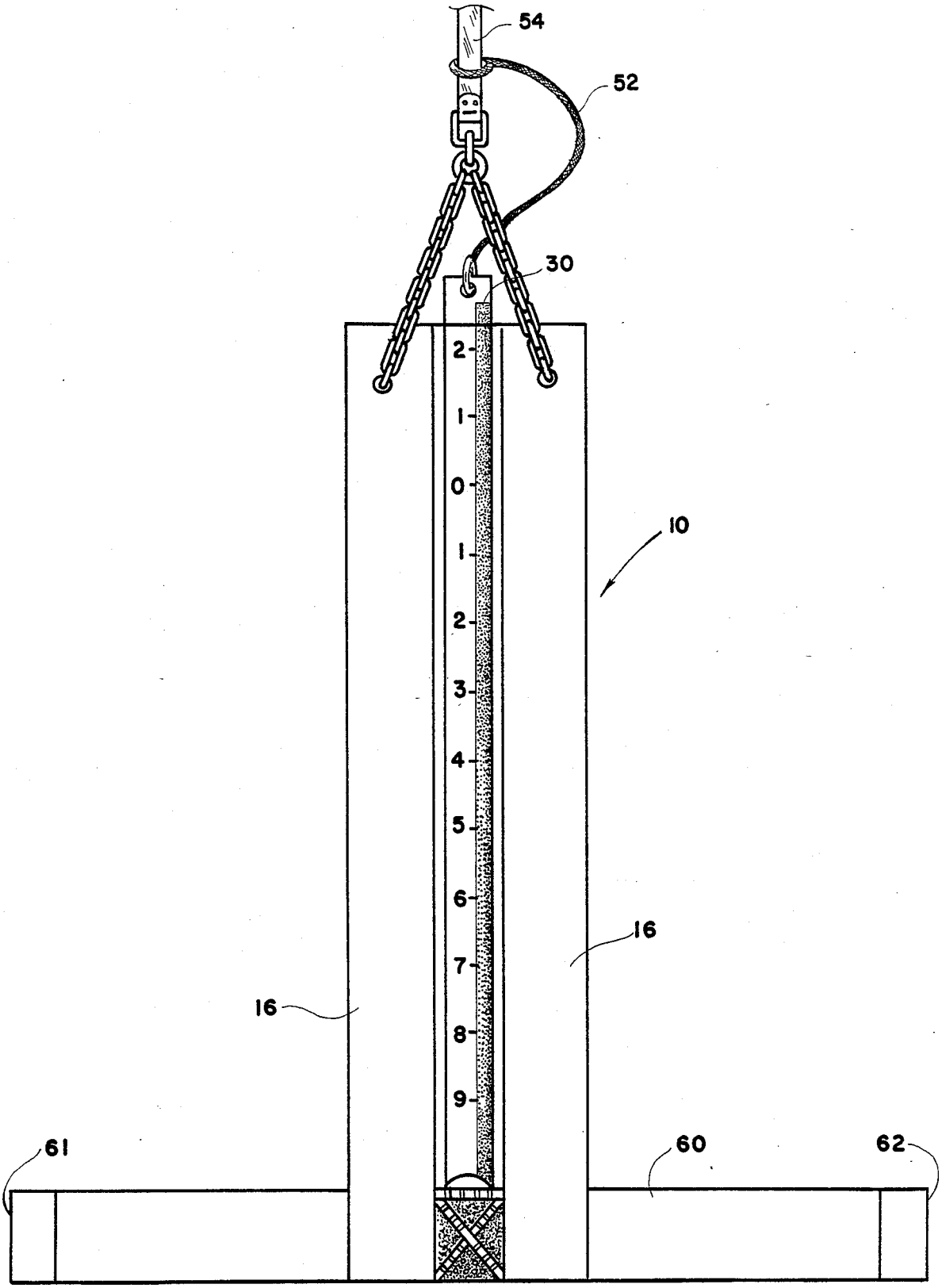
FIG. 4 is a front view of the freeboard measuring device in its alternative embodiment.
Figure 3:
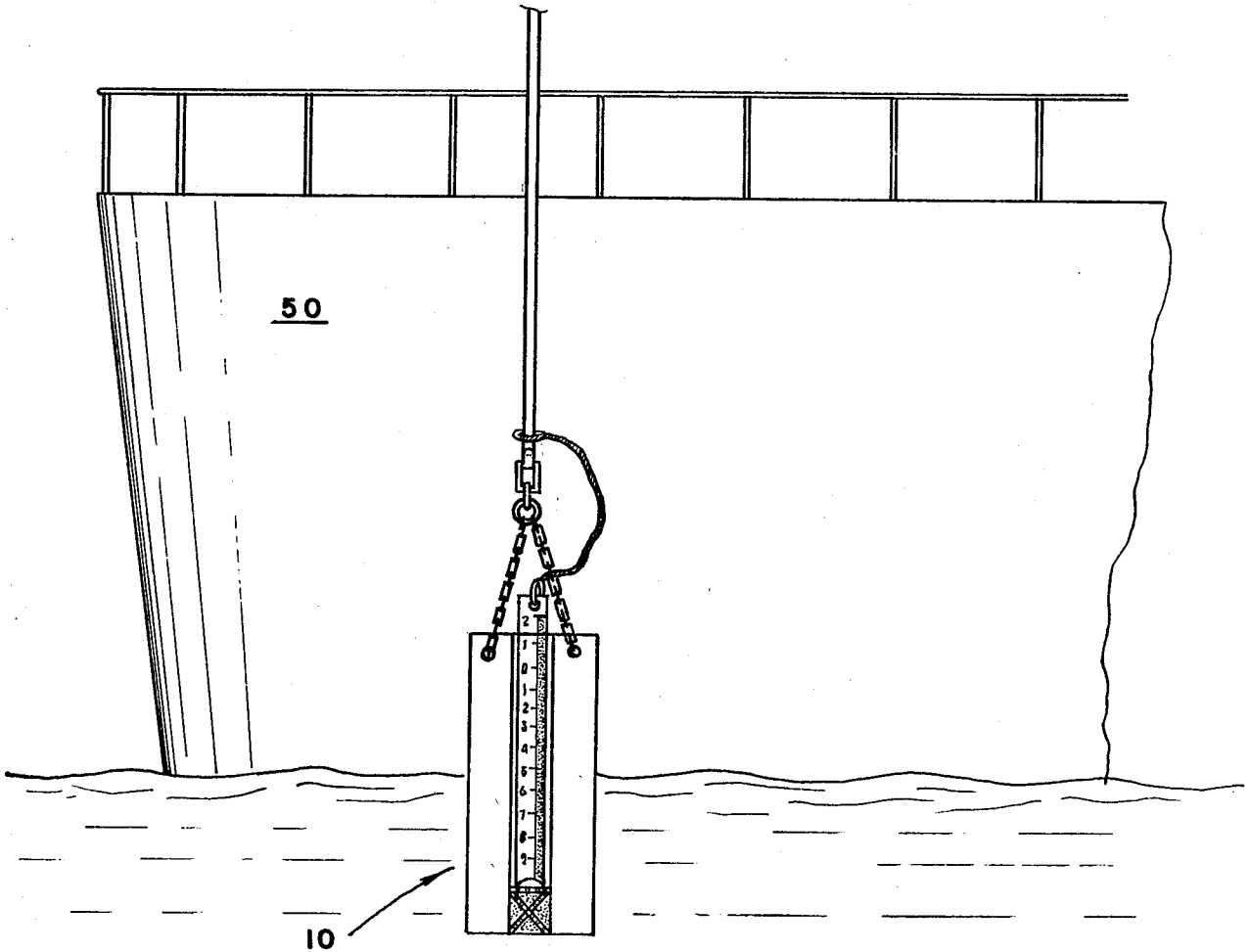
FIG. 3 is a perspective view of a freeboard measuring device in accordance with the present invention in use.

An alternative, or additional, method of preventing turbulence of water in the lower chamber 38, illustrated in FIGS. 4 and 5, provides for the use of an X-shaped insert 62, with the spaces 70, 64, 66, 68 between the insert parts being filled with a similar packing of fibrous material, while additional ports 72 are made in the insert 62 itself in order to allow free flow of water from the exterior of the device 10 into the lower center section 70 of chamber 38 through ports 74, and from there through the sections 64, 66, 68 into the chamber 39 through ports 36.

The transparent wall 28 made of clear plastic, for example, allows easy drilling of ports 40 and 74 and allows visual observation of the gauging stick while the number of ports 48 and 74 is adequate for rapid filling of the upper chamber without turbulence. Additionally, the rate of chamber filling with water can be easily observed, and any blockage of openings or parts can be observed and rectified, if need be. However, other materials, such as aluminum can be used for this purpose.

The chamber 39 has a depth approximating or slightly greater than the thickness of the gauging stick 30 to make the device 10 even more streamlined and the bases of fins are substantially equal to the depth of portion 12.

The gauging stick 30 has a bottom edge 44 which can be concave or jagged in shape, so as not to obstruct openings 36 and impede free fluid communication between the chambers 38 and 39.

The gauging stick 30 is calibrated on one side so that "0" point corresponds to 0'—0" on an oil gauging tape measure which is used in conjunction with the freeboard measuring device.

The other vertically oriented portion of the gauging stick 30 is covered by a strip 46 made of porous material, such as for example, rubber, which can retain, at least temporarily, a water mark, which is easily observed upon withdrawing of the gauging stick 30 from the chamber 39.

In this case, no chalk or water seeking paste which are currently used in the industry for retaining the water mark need to be used. Therefore, rapid freeboard measurements can be taken from different parts of the vessel in succession, since the water mark can be easily erased from the porous material by rubbing it against a dry soft cloth, and the gauging stick can be used immediately again. The need for covering the gauging stick with chalk or water seeking paste is eliminated which saves time to the operator taking measurements. For convenience, the rubber can be of a dark color making the water mark even more easily distinguishing.

The device can be suspended from a vessel 50 by flexible means 48 in the form of an interlock chain, or other flexible material, and an oil gauging tape, in order to facilitate lowering and withdrawal of the measuring device from the vessel. A flexible line 52 such as plastic covered metal fish line can be attached to the top of the dipstick 30 and the oil gauging tape 54 which allows for easy removal and replacement of the dipstick 30 within the chamber 39 without the possibility of dropping the dipstick overboard.

The provision of the recess 18 in which the recessed wall 28 is positioned protects the transparent wall from damage by contact with other vessels, while always allowing a free flow of water into the chamber 38.

In order to prevent entrance of water into the chamber 39 in rainy weather, a plug means 49 can be inserted in the upper top 32 of the chamber 39, surrounding the gauging stick 30, thus ensuring a still further advancement in accurate readings on the gauging stick.

It is preferable that the material from which the portions 12, 14 and 16 are made be rust-proof, lightweight and still durable enough to withstand possible impact on the gauging device with a vessel hull without damaging the device. Such material as aluminum was found suitable for these purposes. The plastic wall 28 can be secured within the recess 18 by gluing or bolting, or other similar method ensuring fixed position of the wall 28 in relation to the walls 20 and 22 providing water tight line of attachment.

Due to the provision of fins 14 and 16 extending on both sides of the central portion 12, the device 10 is provided with streamlined characteristics, allowing it to retain its vertical orientation without being swept downstream by strong water current.

The flat back plate 13 of the central portion 12 allows to bring the device 10 in close proximity to the vessel and does not present any additional obstacle to the water current in which the vessel freeboard is being measured.

It should be noted that still additional advantage of the design of the present invention can be easily appreciated from the fact that water inlet means, or ports 40 or 74, are on the side of the measuring device that is in contact with a vessel. Therefore, water striking an outboard side or rising from below the vessel has negligible, if any, effect on the readings.

The provision of fins 14 and 16 allows elimination of weights which are currently utilized to keep the measuring device in a vertical orientation.

Under certain conditions, a vessel can be listed severely to one side and the device 10 is rotated about its vertical axis, turning slowly in circles. Under such circumstances, accurate measurements are rather difficult to obtain. To overcome such problem, a flat transverse bar 60 is securedly attached in perpendicular relationship to the vertical axis of the device 10, to the bottom portion thereof. It is centered about the axis and its outward edges 61 and 62 are sharpened in order to make the bar itself streamlined, by offering less resistance to a water current. The longitudinal dimensions of the bar 60 can be varied depending on conditions of different areas.

The flat bar 60 is caught by the water current and moves the device 10 to the side of the barge, while retaining it in a vertical orientation.

This alternative embodiment is better shown in FIG. 4 of the drawings.

As can be seen from FIGS. 1–4, the lateral dimension of the fins 14 and 16 is substantially greater than the lateral width of the central portion 12 to allow for a well-balanced freeboard measuring device which is streamlined and not affected by water conditions with swift currents and/or choppy waters. The bar 60 becomes specially convenient under certain conditions, by preventing rotational movement of the device 10 about its vertical axis.

Operation of the device 10 is similar to the operation of the device disclosed in U.S. Pat. No. 4,712,305, the disclosure of which is incorporated herewith by reference.

(a) The device 10 is used by positioning a straight edge of wood or metal (not shown) at the desired location on the main deck of a vessel 50 (FIG. 3), to serve as a planar indicator of the deck for an accurate freeboard reading.

(b) Then the device 10 is lowered to a point where the bottom of the device is at the apparent surface of water. Lowering of the device continues to a minimum of 4' below the water surface and until an even inch reading at the straight edge is obtained and recorded.

(c) The device is held steady for about 4 seconds to ensure that the chamber 39 is filled to the outside water level and is then lifted to the deck.

(d) The gauging stick 30 is removed and the measurement at the water mark is noted and added to the freeboard reading taken at the straight edge on the main deck. The sum of the two measurements provides an accurate freeboard reading.

The strip 46 can be wiped dry and procedures a–d above repeated at the next desired location for average freeboard readings at much faster pace than when using chalk or a water seeking paste.

Many modifications and changes can be made in the disclosed embodiments of the present invention without departing from the subject matter of this invention as defined in the following claims.

The disclosure of the embodiments is not intended to limit the scope of the invention as defined by the appended claims.

I claim:

1. A freeboard measuring device, comprising:

a substantially narrow, flat elongated housing having means for water ingress;

a means for freeboard measurement mounted, at least in part, within the said elongated housing; and a fin means securedly attached to said elongated housing for streamlining said device in water without increasing its resistance to a water flow acting on a side of the housing.

2. The device of claim 1, wherein said elongated housing is substantially rectangular in lateral cross section and is provided with a recess means defining a chamber for receiving said means for freeboard measurement.

3. The device of claim 2, wherein said chamber is divided into a lower and upper chamber portions separated from each other by a separation wall means.

4. The device of claim 3, wherein said separation wall means is provided with at least one opening allowing fluid communication between said lower and upper chamber portions.

5. The device of claim 4, wherein said chamber has a closed bottom, closed sides and an open top, allowing removable positioning of said means for freeboard measurement inside said chamber.

6. The device of claim 5, wherein one side of said chamber is defined by a front wall having means for water ingress associated therewith.

7. The device of claim 1, wherein said fin means comprises a pair of fins having triangular cross section and attached to opposite sides of said elongated housing.

8. The device of claim 7, wherein said fins have longitudinal dimensions substantially similar to a longitudinal dimension of said elongated housing.

9. The device of claim 7, wherein a lateral dimension of each of said fins is at least slightly greater than a lateral dimension of said elongated housing.

10. The device of claim 7, wherein said fins have acute angle outer edges for offering less resistance to a water flow.

11. The device of claim 1, wherein said means for freeboard measurement comprise a calibrated gauging stick having a strip of porous moisture-sensitive material attached thereto, said strip retaining, at least temporarily, a water mark upon contact with water.

12. The device of claim 11, wherein said gauging stick has a concave bottom part allowing unobstructed flow of water within said housing.

13. The device of claim 1, further comprising means for stabilizing vertical orientation of the freeboard measuring device.

14. The claim 13, wherein said means for stabilizing comprise a transverse bar securedly attached to a lower portion of said housing.

15. The device of claim 1, further comprising means for preventing water ingress from a top of said housing.

16. The device of claim 15, wherein said means for preventing water ingress comprise a plug attachable to the top of the housing.

17. A freeboard measuring device, comprising:

an elongated housing having means for water ingress, said elongated housing being substantially rectangular in cross section;

a means for freeboard measurement mounted, at least in part, within said elongated housing;

said elongated housing being provided with a recess means defining a chamber for receiving said means for freeboard measurement, said chamber being divided into a lower and upper chamber portions separated from each other by a separation wall means, wherein said lower chamber portion is provided with means to prevent water turbulence inside the lower chamber portion; and a fin means securedly attached to said elongated housing for streamlining said device in water.

18. The device of claim 17, wherein said means to prevent water turbulence comprise a packing of fibrous material positioned inside the lower chamber portion.

19. The device of claim 17, wherein said means to prevent water turbulence comprise an X-shaped insert positioned inside the lower chamber portion.

20. A freeboard measuring device, comprising:

an elongated housing having means for water ingress;

a means for freeboard measurement mounted, at least in part within said elongated housing, said means for freeboard measurement comprising a calibrated gauging stick having a strip of porous moisture-sensitive material attached thereto. said strip retaining, at least temporarily, a water mark upon contact with water, wherein said gauging stick has a jagged part allowing unobstructed flow of water within said housing; and;

a fin means securedly attached to said elongated housing for streamlining said device in water.

21. A freeboard measuring device, comprising:

a substantially narrow, flat elongated housing having a front wall and a rear wall, said elongated housing provided with a water ingress means on the front wall thereof;

a fin means integrally attached to opposing sides of said housing, said fin means comprising a pair of fins having a triangular cross section for streamlining said device in water by reducing its resistance to a water flow acting on a side of a housing, a lateral dimension of each of said fins being at least equal to a lateral dimension of said housing; and a means for freeboard measurement mounted, at least in part, within said elongated housing.

22. The device of claim 21, wherein the housing is provided with a separation wall on an interior thereof, dividing the housing into a lower chamber and an upper chamber.

23. The device of claim 22, wherein said water ingress means is in fluid communication with the lower chamber.

24. The device of claim 23, wherein said separation wall is provided with at least one opening allowing fluid communication between said lower and said upper chambers.

25. The device of claim 22, wherein said means for freeboard measurement is removably positionable within said upper chamber, said means for freeboard measurement comprising a calibrated gauging stick having a strip of moisture-sensitive material attached thereto, said strip retaining, at least temporarily, a water mark upon contact with water.

26. The device of claim 21, wherein said housing is provided with a recessed front wall made of a transparent material allowing visual observation of an interior of the housing.

27. The device of claim 21, further comprising means for stabilizing vertical orientation of the freeboard measuring device, said stabilizing means comprising a transverse bar securedly attached to a lower portion of said housing in substantially perpendicular relationship to a longitudinal axis of said housing.

28. A freeboard measuring device, comprising:

an elongated housing having a front wall and a rear wall, said elongated housing being provided with a water ingress means on the front wall thereof;

Said housing being provided with a separation wall on an interior thereof, dividing the housing into a lower chamber

29. The device of claim 28, wherein said means for preventing turbulence comprise a packing of fibrous material positioned inside the lower chamber.

30. The device of claim 29, wherein said means for preventing turbulence further comprise an X-shaped insert positioned inside the lower chamber.

* * * * *